US006328247B1

(12) United States Patent
Fechter et al.

(10) Patent No.: US 6,328,247 B1
(45) Date of Patent: Dec. 11, 2001

(54) CHEESE-PRODUCING TEXTILE MACHINE

(75) Inventors: Ulrich Fechter, Mönchengladbach; Bernd Werner, Kamp-Lintfort, both of (DE)

(73) Assignee: W. Schlafhorst AG & Co., (DE)

( * ) Notice: Subject to any disclaimer, the term of this patent is extended or adjusted under 35 U.S.C. 154(b) by 0 days.

(21) Appl. No.: 09/373,421

(22) Filed: Aug. 12, 1999

(30) Foreign Application Priority Data

Aug. 13, 1998 (DE) ..... 198 36 702

(51) Int. Cl.[7] ..... B65H 67/04; B65H 54/26

(52) U.S. Cl. ..... 242/473.6; 242/473.5; 242/473.7; 242/473.8

(58) Field of Search ..... 242/473.6, 473.5, 242/473.7, 473.8, 475.7

(56) References Cited

U.S. PATENT DOCUMENTS 5,853,137 * 12/1998 Straaten et al. ..... 242/473.6
5,857,637 * 1/1999 Straaten et al. ..... 242/473.7
6,014,592 * 1/2000 Fechter et al. ..... 242/473.6 X
6,138,937 * 10/2000 Straaten et al. ..... 242/473.6

FOREIGN PATENT DOCUMENTS 39 11 505 A1 10/1990 (DE) .
43 36 312 A1 4/1995 (DE) .
195 33 833 A1 3/1997 (DE) .
196 46 564 A1 5/1998 (DE) .
196 50 879 A1 6/1998 (DE) .
196 50 932 A1 6/1998 (DE) .

* cited by examiner

*Primary Examiner*—Donald P. Walsh
*Assistant Examiner*—Minh-Chau Pham
(74) *Attorney, Agent, or Firm*—Kennedy Covington Lobdell & Hickman, LLP

(57) ABSTRACT

A cheese-producing textile machine (1), having a central control unit (37), a plurality of work stations (2), and a service unit (23), which automatically supplies the work stations (2). The work stations (2) each have a winding device with a winding drum (17), which is individually driven by a motor, and a work station computer (39). The central control unit (37) is connected via a machine bus (40) with the work station computers (39) and with a control device (39) of the service unit (23). Specific winding drum data (x, y), in particular the number of traverses (g) of the winding drum (17) of the work stations (2), are stored in a memory, e.g., integrated in the central control unit (37). During the yarn pickup by means of the yarn lifter (41) of the service unit (23) in the course of a cheese change, the individual electric motor drive (50) of the winding drum (17) is controlled to match the number of revolutions of the winding drum (17) to the number of traverses (g) thereof.

6 Claims, 4 Drawing Sheets

CHEESE-PRODUCING TEXTILE MACHINE

FIELD OF THE INVENTION

The present invention relates to a cheese-producing textile machine, comprising a plurality of work stations, each having a winding drum individually driven by its own respective motor and precisely controlled by a work station computer, and a service unit which automatically supplies the work stations.

BACKGROUND OF THE INVENTION

Cheese-producing textile machines of the above-described type are known from various patent applications. For example, German Patent Publications DE 196 46 564 A1 and DE 196 50 932 A1 describe such textile machines, designed as automatic bobbin (cheese) winding machines. These so-called automatic cheese winders respectively have a plurality of work stations of the same type, arranged in a row next to each other. Each work station itself has a winding device with a winding drum, driven by an individual motor, as well as a work station computer.

Ring-spinning cops are rewound into cheeses of large volume in the work stations. The work stations are supplied with cops by a service unit, which can be moved along the work stations, i.e. when needed, the service unit automatically travels to the respective work station and exchanges a finished cheese for an empty cop tube which has been rewound at the work station.

Such textile machines also have a central control unit, which is connected via a machine bus with the individual respective work station computers, as well as with the control device of the service unit.

The service unit, preferably a so-called cheese changer, has numerous manipulating devices for transferring the cheeses finished on the winding device of the work stations to a cheese transport device extending over the length of the machine, as well as for the subsequent insertion of an empty cheese-winding tube into the creel.

As extensively described in German Patent Publication DE 195 33 833 A1, such cheese changers have, among other things, a yarn lifter, which is pivoted into the path of the yarn moving from the feed bobbin to the delivery bobbin at the start of the exchange process. In this operation, the yam lifter grasps the yarn, which is cross-wound from a winding drum, preferably designed as a reversing gear roller. The caught yarn is subsequently cut into an upper yarn end and a lower yarn end by a yarn cutting and clamping device arranged on the yarn lifter.

Subsequently the upper yarn end is wound on the tip of the tube of the finished cheese, for example as a top cone winding, while the bottom yarn is positioned between the tube receiver of the creel of the winding station and a fresh empty tube such that it is clamped during the subsequent locking of the empty tube. When the winding station is restarted, the tube maintained in the creel is frictionally driven by the winding drum, and in the process the lower yam end is guided by the yarn lifter in such a way that first a so-called foot or reserve winding is created on the tube foot. Thereafter, the lower yarn end, which is delivered from a ring-spinning cop, is unwound therefrom and is cross-wound in the yarn guide groove of the winding drum such that a fresh cheese is created of the "random winding" type.

Depending on the desired bobbin format, winding drums of different embodiments are used in the work stations. The winding drums used can be configured with 1.5 traverses, 2 traverses, 3 traverses, etc. However, it is disadvantageous in the known automatic cheese winders that with the yarn pick-up, which becomes necessary at the start of the exchange process, the winding drums are always driven for a fixed, predetermined length of time. This length of time is of such duration that even with winding drums with a maximum number of traverses it is still assured that the yarn is dependably fed to the yarn lifter, as a rule at least twice. Thus, the length of time, and therefore the number of revolutions which the winding drum performs during yarn pick-up, is always the same. The number of traverses of the winding drum used are completely disregarded in the yam pick-up operation.

OBJECT AND SUMMARY OF THE INVENTION

Departing from textile machines of the above mentioned type, an object of the present invention is to improve such textile machines.

In accordance with the invention, this object may be attained in a cheese-producing textile machine which basically comprises a plurality of work stations; each work station having a winding drum, an individual work station computer for precisely controlling the winding drum of the respective work station, and an individual motor for individually driving the winding drum of the respective work station; and a service unit for automatically supplying the work stations. According to the present invention, means are provided for storing in a memory data regarding a number of traverses of the winding drum and a control means is provided for processing these data to determine a number of revolutions of the winding drum as a function of the stored number of traverses of the winding drum for feeding a yarn to the work station.

The described embodiment of a cheese-producing textile machine in accordance with the present invention has the advantage that, during the yarn pick-up operation (i.e., the feeding of the yarn to the work station), the revolutions of the winding drum are matched to the respectively employed type of winding drum, in particular to the number of traverses of the winding drum. In this manner, it is assured, on the one hand, that the yarn, which is being cross-wound by the winding drum, is always fed to the yarn winding drum in such a way, that the yarn can be dependably picked up by the drum and, on the other hand, that repeated, superfluous cross-winding of the yarn is avoided.

This means that the time necessary for picking up the yarn by the winding drum can be reduced up to 60% by means of the exact matching of the winding drum revolutions to the number of traverses of the respective winding drum. The resultant shortening of the cycling time of the cheese changes which thereby can be achieved has a positive effect as a whole, since the availability of the service unit to the various winding stations is increased and therefore the efficiency of the textile machine also increases.

In a preferred embodiment, the data regarding the number of traverses of the winding drum employed are stored in the central control unit of the textile machine. Since the central control unit is connected via a machine bus with the individual work station computers, as well as with the control device of the service unit, the winding drum data are always available, or can be transferred to the respective control device initially at the onset of a batch start. Thus, no additional hardware is required for the present invention.

Control of the individual electric motor drive of the winding drum as a function of the winding drum data, which preferably have been stored in the central control unit, takes place either via the work station computer of the respective winding station or via the control device of the service unit, which has been positioned at the respective winding station.

Since, as already mentioned above, the central control unit of the textile machine is connected via the machine bus with the work station computers of the individual winding stations, as well as with the control device of the service unit, a transfer of the winding drum data stored in the central control unit to these electronic control elements is possible at any time.

Therefore the control of the individual electric motor drive of the winding drum as a function of the number of traverses of the winding drum can selectively take place by means of the work station computer of the respective winding station, as well as by the control device of the service unit positioned in front of the winding station.

Further details, features and advantages of the present invention will be understood from an exemplary embodiment described hereinafter with reference to the accompanying drawings.

DETAILED DESCRIPTION OF THE PREFERRED EMBODIMENT

Figure 1:
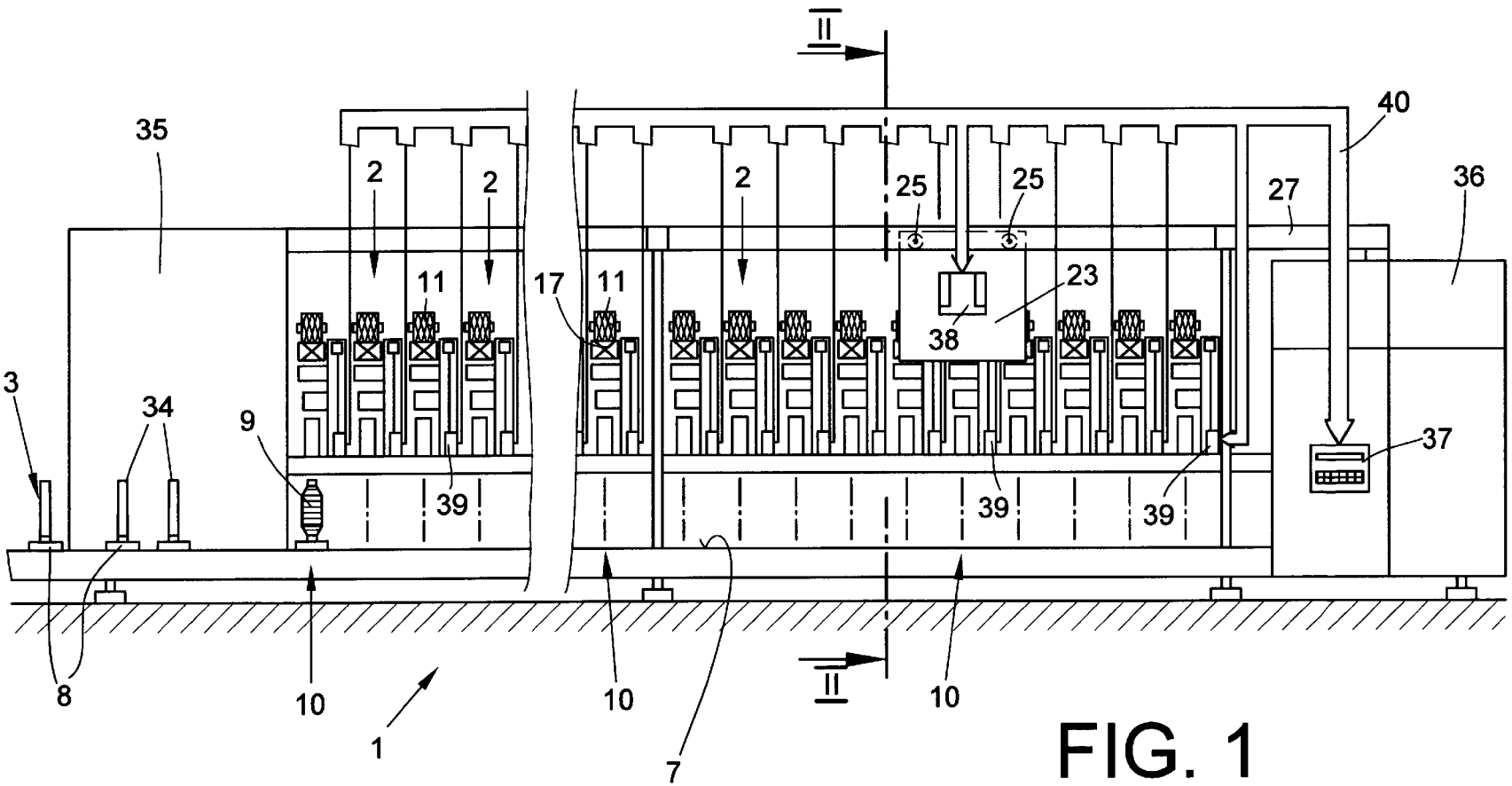
FIG. 1 is a front view of a cheese-producing textile machine with a plurality of work stations and with a service unit, which can be moved along the work stations, wherein the work station computers and the control device of the service unit are connected with a central control unit of the textile machine via a machine bus, in accordance with the present invention.

A cheese-producing textile machine, in the exemplary embodiment an automatic cheese winder, is identified as a whole by the reference numeral 1 in FIG. 1. Usually such automatic cheese winders have a plurality of work stations of the same type between their end frames 35, 36, in this case winding stations 2, also referred to as winding heads. As is known and therefore not explained in greater detail, spinning cops 9, produced on a ring spinning machine (not represented), are rewound into large volume cheeses 11 by these winding stations 2.

The finished cheeses 11 are transferred out of their winding stations by means of an automatically operating service unit, for example by means of a cheese changer 23, which operates to roll each finished cheese 11 onto a cheese transport device 21, by which the cheeses 11 are conveyed to a bobbin loading station (not represented) or the like arranged at the end of the machine.

As a rule, such automatic cheese winders 1 have a logistic device in the form of a bobbin and tube transport system 3, particularly if the automatic cheese winder is connected together with one or several ring spinning machines. Spinning cops 9, as well as empty tubes 34, circulate on transport plates 8 in the bobbin and tube transport system 3.

Furthermore, such automatic cheese winders 1 have a central control unit 37, which is connected via a machine bus 40 with the individual respective work station computers 39 of the individual winding stations 2, as well as with the control device 38 of the service unit 23 which automatically supplies cops to the winding stations 2.

Figure 2:
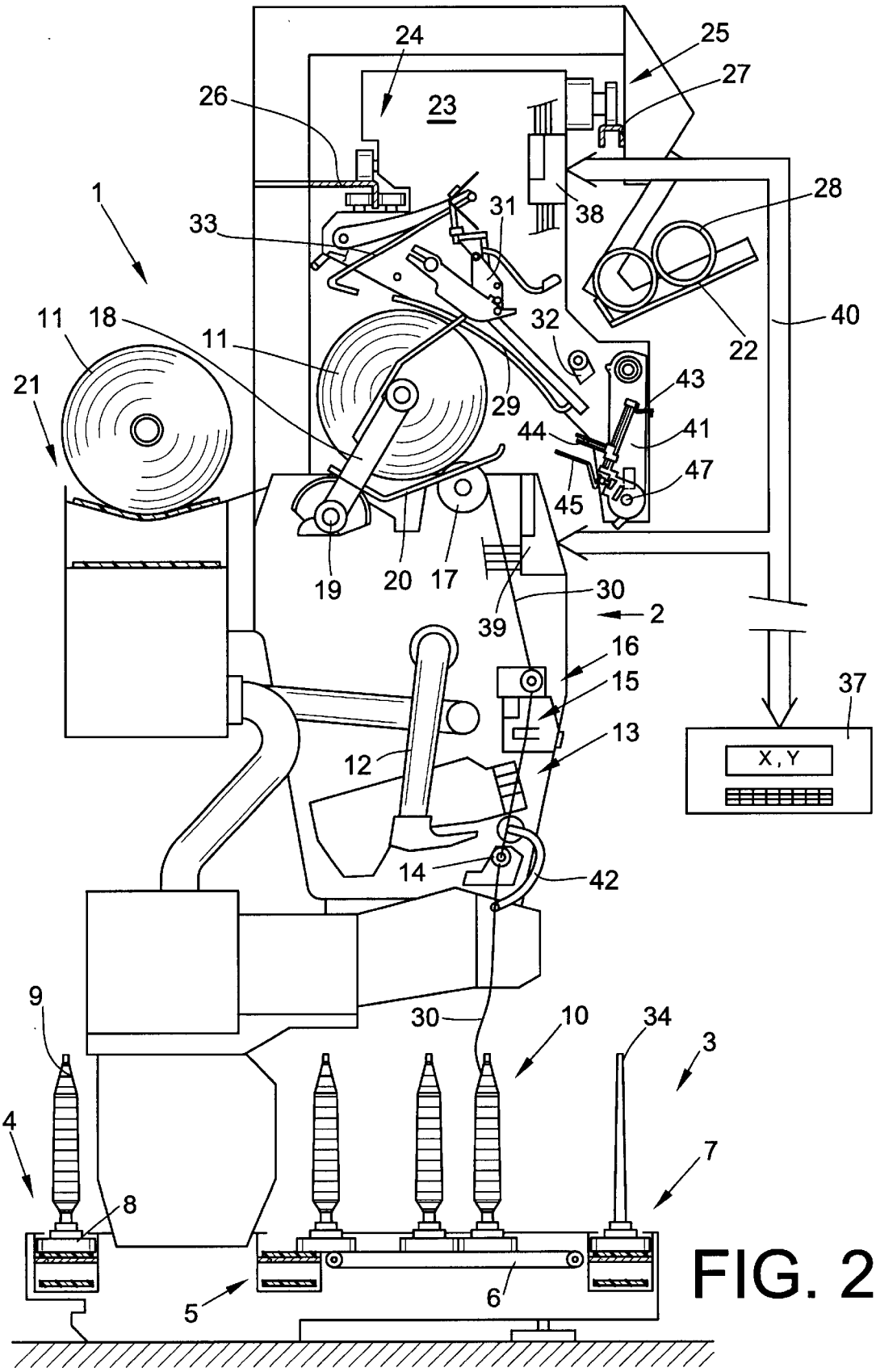
FIG. 2 is a lateral view of a winding station of an automatic cheese winder in accordance with the section II—II in FIG. 1, with a service unit positioned at the winding station at the start of a cheese changing cycle.
Figure 3:
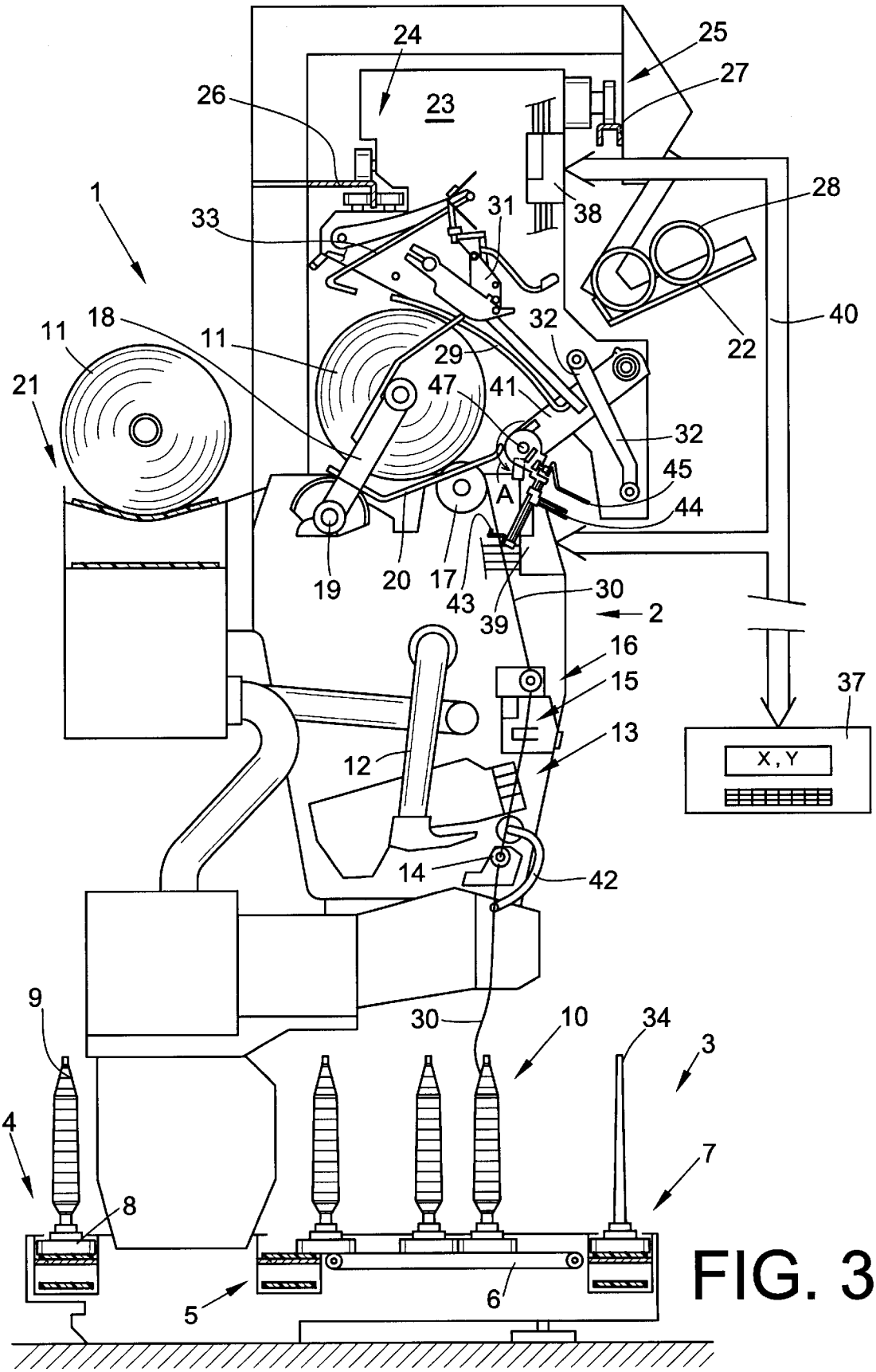
FIG. 3 is another lateral view of the winding station of the automatic cheese winder of FIG. 2 in the course of the yam pick-up by the yarn lifter of the service unit.

As can be seen in FIGS. 2 and 3, the service unit 23 is movably seated by means of running gear 24, 25 rolling on tracks 26, 27 extending over the length of the machine. In this case, the service unit 23 not only functions to roll the cheeses 11, which had been finished on the winding stations 2, out of the winding stations 1 onto the cheese transport device 21, but also automatically inserts an empty cheese tube 28 into the creel 18 of the respective winding station 2. In the course of this operation, the service unit 23 preferably removes the respective empty tube 28 from an empty tube magazine 22, which is a part of the winding station.

As already indicated above, such textile machines have a bobbin and tube transport system 3. Of this extensive transport system 3, only the sport track 4 extending over the length of the machine, the reversing cop supply track 5 extending behind the winding stations 2, one of the transverse transport tracks 6 leading to the winding stations 2, as well as the empty tube return track 7, are represented in FIGS. 2 and 3.

In the unwinding positions 10, which are located in the area of the transverse transport racks 6, the yarns from the spinning cops 9 are unwound and are wound into a large volume cheese 11 on the winding device of the respective work station 2.

As is known and therefore only schematically shown, the individual winding stations 2 have various devices for assuring the correct operation of such work stations 2. In FIGS. 2 and 3, the yarn running from a spinning cop 9 to a cheese 11 is indicated by 30, a suction nozzle is indicated by 12, a gripper tube is indicated by 42, a splicing device is indicated by 13, a yarn tensioning device is indicated by 14, a yarn cleaner with a yarn cutting device is indicated by 15, and a paraffin application device is indicated by 16.

Figure 4A:
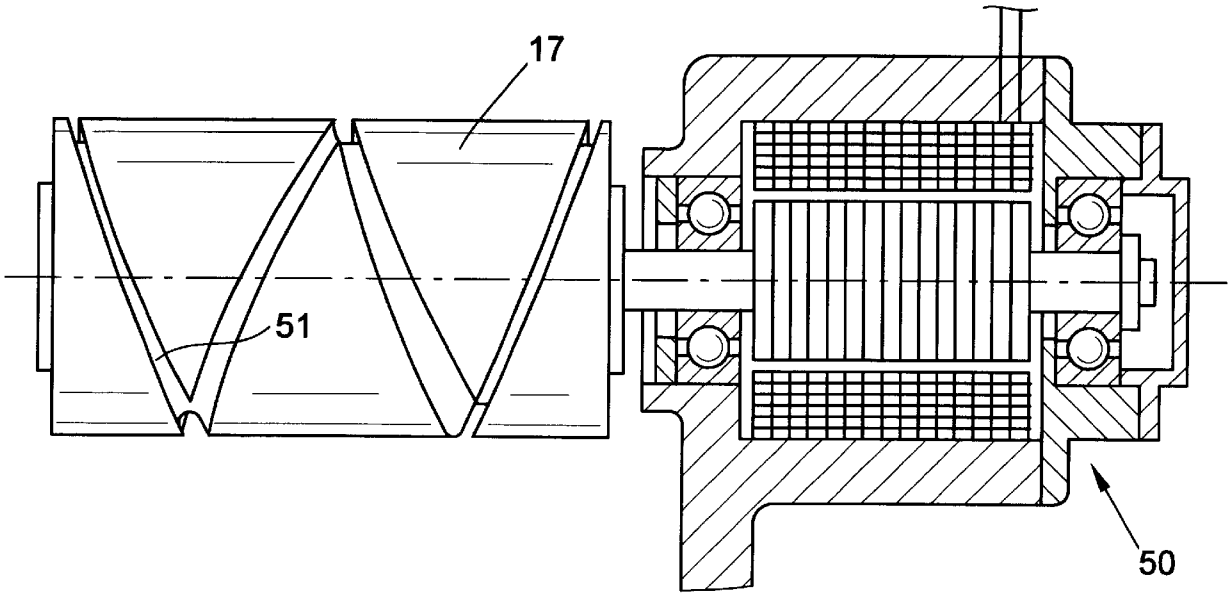
FIGS. 4*a* to 4*c* show winding drums with various numbers of traverses.

As indicated in FIG. 4*a*, the winding drum 17 is driven by an individual electric motor drive 50 and acts by means of a frictional connection on the cheese 11, which is held in a creel 18 during the winding process. As is customary, the creel 18 is seated, and is pivotable around a shaft 19. A pivot sheet 20 is located underneath the creel 18 and is also pivotable around the shaft 19 in a limited manner, over which the finished cheese 11 can be transferred to the cheese transport device 21 extending behind the winding stations 2.

As indicated, the winding stations 2 are supplied by means of a service unit, the socalled cheese changer 23 which is operative to move the finished cheeses 11, which have attained a predetermined diameter, out onto the cheese transport device 21. Thereafter, the service unit 23 inserts an empty tube 28 from the empty tube magazine 22 into the creel 18.

Some manipulation elements, which are required in the course of the exchange process between cheese and empty tube, are represented in FIGS. 2 and 3. The most important manipulation elements here are the creel opener 29, the creel lifter 32, the bobbin guide device 33, the empty tube feeder 31, as well as the yarn lifter 41. A yarn catch plate 43, whose yarn catching contours are opened in a funnel shape at both sides, is arranged at the end of the yarn lifter 41.

A clamping cutter 44, i.e. a yarn cutter with a yarn clamp placed ahead of it, is located underneath the yarn catch plate 43. The clamping cutter 44 can be precisely controlled by means of a pneumatic cylinder (not represented). In addition, a yarn guide plate 45 is ranged in the area of the pivot shaft 47 of the yarn lifter 41.

Figure 4B:
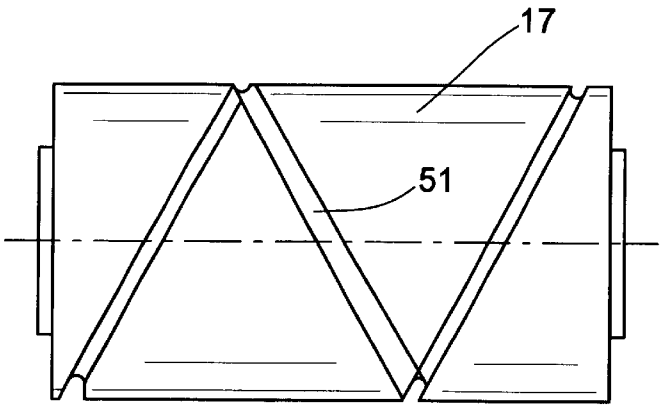
Figure 4C:
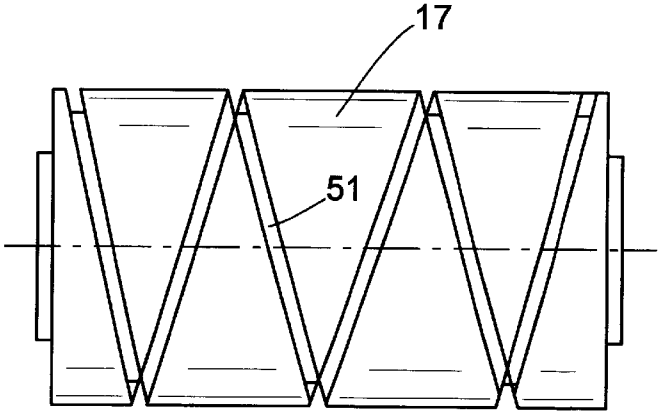

FIGS. 4*a* to 4*c* represent different embodiments of winding drums, such as can be employed in the winding stations 2 of cheese- producing textile machines. FIG. 4*a* shows by way of example a so-called double-traverse winding drum 17. Here, the winding drum 17 is acted upon by an electric motor drive 50. Such electric motor drives are known and are extensively described, for example in German Patent Publication DE 43 36 312 A1. As is customary, the winding drum 17 has a yam guide groove 51, which has been cut into the drum body in such a way that the yarn guided in the yam guide groove 51 is displaced from one end of the drum to the other after two revolutions of the drum.

Alternatively, with the 1.5-traverse winding drum 17 represented in FIG. 4*b*, only one and one-half revolutions of the drum are required in order to displace the yarn guided in the yarn guide groove 51 from one end of the drum to the other. The triple-traverse winding drum 17 in accordance with FIG. 4*c* correspondingly requires three drum revolutions for a yarn displacement from one end of the drum to the other.

The functioning of the device is as follows. If there is a service requirement at one of the work stations 2 of the cheese-producing textile machine 1, because a cheese 11 has reached its predetermined maximum diameter, the work station computer 39 of the respective winding station 2 advises the control device 38 of the service unit 23 via the machine bus 40, which thereupon moves to the respective work station 2 and is locked in place thereat. At the same time the specific required winding drum data x, y are forwarded via the machine bus 40 from the central control device 37 of the textile machine 1 to the work station computer 39 of the respective winding station 2 or, depending on the drive concept, to the control device 38 of the service unit 23. In an alternative embodiment, it is of course also possible for the winding drum data x, y to have already been sent to and stored in the respective control device 38 or 39 via the machine bus 40 at the onset of the batch start.

At the start of the exchange process, the cheese changer 23 positioned in front of the winding station 2 first pivots its yarn lifter 41 from the "standby position" indicated in FIG. 2 into the "yarn pickup position" represented in FIG. 3. In the yarn pickup position, the yarn catch plate 43 arranged at the end of the yarn lifter 41 is positioned in the cross-winding area of the yarn 30, which can be laterally displaced by the winding drum 17.

Thereupon the individual electric motor drive 50 of the winding drum 17 of the respective winding station 2 is controlled by the control device 38 of the service unit 23 or the work station computer 39 of the respective work station 2 such that the number of revolutions performed by the winding drum 17 during the yarn pickup is exactly matched to the number of traverses of the respectively employed winding drum.

In an alternative embodiment it is also conceivable that the drive of the cheese and the winding drum takes place by means of an auxiliary drive arranged on the service unit, e.g., a precisely drivable friction wheel is placed against the surface of the cheese in a known manner and rotates the cheese and, by means of a frictional connection, the winding drum. In this case, the cheese is acted upon in such a way that the number of revolutions of the winding drum is matched to the number of its traverses.

The yarn 30, which is cross-wound by means of the winding drum 17, is securely caught in the yarn catching contours of the yarn catch plate 43, and the yarn lifter 41 is subsequently again pivoted back into its standby position (FIG. 2). In the course of this operation, the yarn 30, which is steadied by the yarn guide plate 45, is threaded into the clamping cutter 44.

Subsequently, the yarn is initially wound on the tube tip of the cheese 11 as a top reserve winding and is then severed by the clamping cutter 44 into an upper yarn end and a lower yarn end.

Thereafter, the cheese is moved out of its creel in the customary manner aforementioned by appropriate manipulation devices of the service unit onto the transport device extending over the length of the machine. In this case, the lower yarn end remains temporarily fixed in place in the clamping cutter 44. Thus, after the cheese has been moved out, the bottom yarn is applied to a new empty tube freshly inserted into the winding station creel and wound on the tube foot as a bottom reserve yarn winding.

The exact progression of the process of such a cheese/empty tube exchange, particularly with the use of the above described yarn lifter, is known per se and is extensively described, for example in German Patent Publication DE 195 33 833 A1.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a fill and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A cheese-producing textile machine, comprising a plurality of work stations; each work station having a winding drum, an individual work station computer for precisely controlling the winding drum of the respective work station, and an individual motor for individually driving the winding drum of the respective work station; a service unit for automatically exchanging cheeses in the work stations for cops; means for storing in a memory data regarding a number of traverses of the winding drum; and a control means for processing the data to determine a number of revolutions of the winding drum as a function of the stored number of traverses of the winding drum for feeding a yarn to the work station.

2. The cheese-producing textile machine in accordance with claim 1, further comprising a central control unit of the textile machine which comprises the data storing means, the central control unit being connected via a data bus with the work station computer and with a control device of the service unit.

3. The cheese-producing textile machine in accordance with claim 2, wherein the control device of the service unit controls the motor to drive the winding drum in accordance with the stored winding drum data.

4. The cheese-producing textile machine in accordance with claim 1, wherein the number of revolutions of the winding drum during the yarn feeding is selected to correspond to the number of traverses of the respective winding drum.

5. The cheese-producing textile machine in accordance with claim 1, wherein the work station computer controls the motor to drive the winding drum in accordance with the stored winding drum data.

6. In a cheese-producing textile machine having a plurality of work stations and a service unit for exchanging a cheese in at least a first work station for a cop, wherein the first work station includes a winding drum, a motor for driving the winding drum, and a work station computer for controlling the winding drum using the motor, a method of controlling the winding drum in conjunction with the exchanging of a cheese, the method comprising the steps of:

storing data regarding the number of traverses of the winding drum;

determining, as a function of the stored number of traverses, a number of revolutions to be completed by the winding drum during the cheese exchange process; and during the cheese exchange process, using the motor to control the winding drum according to the determined number of revolutions.

* * * * *